US009816355B2

(12) United States Patent
Akers et al.

(10) Patent No.: US 9,816,355 B2
(45) Date of Patent: Nov. 14, 2017

(54) MULTI-PURPOSE THROUGH TUBING TOOL

(71) Applicant: BAKER HUGHES INCORPORATED, Houston, TX (US)

(72) Inventors: Clyde F. Akers, Parks, LA (US); Ryan C. Holcomb, Houma, LA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 492 days.

(21) Appl. No.: 14/340,174

(22) Filed: Jul. 24, 2014

(65) Prior Publication Data

US 2016/0024889 A1 Jan. 28, 2016

(51) Int. Cl.
*E21B 23/01* (2006.01)
*E21B 37/02* (2006.01)

(52) U.S. Cl.
CPC ..... *E21B 37/02* (2013.01)

(58) Field of Classification Search
CPC ..... E21B 37/02; E21B 10/32; E21B 10/322; E21B 17/1078; E21B 29/00; E21B 29/005; E21B 37/00; E21B 37/04
See application file for complete search history.

(56) References Cited

U.S. PATENT DOCUMENTS 1,573,679 A * 2/1926 Crosby ..... E21B 37/02 15/104.16
2,278,026 A * 3/1942 Smith ..... E03F 9/002 15/104.31
2,328,060 A * 8/1943 Crane ..... B08B 9/055 15/104.061
2,657,506 A * 11/1953 Hadley ..... B08B 9/0553 15/104.061
2,756,968 A * 7/1956 Emanuel ..... E21B 10/322 175/269
2,781,100 A * 2/1957 Pyle ..... E21B 37/02 15/104.001
2,812,624 A * 11/1957 Billeter ..... B24B 33/084 451/485
2,958,884 A * 11/1960 Hill ..... B08B 9/0553 15/104.061
3,381,754 A * 5/1968 Tompkins ..... E21B 37/02 15/104.14

(Continued)

FOREIGN PATENT DOCUMENTS

WO 0166907 9/2001
WO WO 2012060712 A1 * 5/2012 ..... B08B 9/0436
WO WO 2015137819 A1 * 9/2015 ..... E21B 37/02

*Primary Examiner* — Daniel P Stephenson
(74) *Attorney, Agent, or Firm* — Steve Rosenblatt

(57) ABSTRACT

A tubular cleaning tool can be delivered through tubing and then hydraulically or mechanically actuated to rotate blades about respective pivot location into approximately a 45 degree orientation for commencement of tool rotation and cleaning a larger tubular that is below. Each of the blades has a cantilevered distal end that further features at least one articulated link. The outer periphery of the articulated distal segment has hard facing to enhance the cleaning effect and to reduce blade wear. The remainder of the blade outer surface can also have hard facing for similar reasons. The distal segment can be biased toward the surrounding tubular when the blades extend to put the segment in the needed orientation for cleaning.

54 Claims, 3 Drawing Sheets

(56) References Cited

U.S. PATENT DOCUMENTS 3,983,938 A * 10/1976 Hellums ..... E21B 37/02 166/175
4,119,151 A * 10/1978 Smith ..... E21B 29/00 166/298
4,279,299 A * 7/1981 Shuck ..... E21B 37/00 166/277
4,440,229 A * 4/1984 Burch ..... E21B 17/1078 166/311
4,809,779 A 3/1989 Ledyashov et al.
4,827,553 A * 5/1989 Turpin, Sr. ..... F16L 45/00 134/21
4,938,291 A * 7/1990 Lynde ..... B23B 5/16 166/55.8
5,000,260 A * 3/1991 Fontenot ..... E21B 37/02 15/104.16
5,038,859 A * 8/1991 Lynde ..... E21B 10/46 166/55.6
5,060,738 A * 10/1991 Pittard ..... E21B 29/005 166/55.8
5,735,359 A * 4/1998 Lee ..... E21B 10/322 175/269
6,152,221 A 11/2000 Carmichael et al.
6,343,648 B1 2/2002 Carmichael et al.
6,484,802 B1 11/2002 McGarian et al.
6,745,839 B1 * 6/2004 Simpson ..... E21B 37/02 166/173
2006/0201670 A1 9/2006 Stewart
2007/0039760 A1 * 2/2007 Zijsling ..... E21B 10/322 175/267
2009/0313781 A1 12/2009 Gray
2010/0006279 A1 * 1/2010 Martinez ..... E21B 44/005 166/53
2010/0258354 A1 * 10/2010 Eriksen ..... E21B 10/60 175/267
2010/0263856 A1 * 10/2010 Lynde ..... E21B 23/14 166/53
2012/0018163 A1 * 1/2012 Nelson ..... E21B 37/08 166/312
2014/0150822 A1 * 6/2014 Osaland ..... B08B 9/0436 134/8
2015/0034311 A1 * 2/2015 Tunget ..... E21B 7/20 166/250.14
2016/0024889 A1 * 1/2016 Akers ..... E21B 37/02 166/311
2016/0138369 A1 * 5/2016 Tunget ..... E21B 37/02 166/311
2016/0230508 A1 * 8/2016 Jensen ..... E21B 37/02

* cited by examiner

MULTI-PURPOSE THROUGH TUBING TOOL

FIELD OF THE INVENTION

The field of the invention is rotary tubular scrapers/mills/hones and more particularly tools with pivotally mounted arms to allow the tool to pass through smaller tubing to scrape or hone a larger tubular.

BACKGROUND OF THE INVENTION

Tubular cleaning up is a common procedure in situations such as after cementing but it also is used in other contexts. Most typically the tubular is casing and in applications where the size of the casing declines as the hole gets deeper. In those instances the scrapers typically comprise one or more rounded elements supported on a mandrel that is rotated either from the surface or with a downhole motor. The elements can be brushes that are spring biased outwardly against the tubular wall. The elements are supported from the mandrel against the torsional loads that occur during the scraping operation. Some examples of such scrapers are U.S. Pat. Nos. 6,343,648; 4,809,779; 6,152,221 and 6,484,802. Some designs involve linkages that extend opposed ends of scraping elements such as WO2001066907 to allow scraping of different size casing in the same trip. Also of general interest in the area of scrapers are US20060201670 and US20090313781 which illustrates a hand held scraper with a spring loaded blade.

Situations arise where the scraping needs to be done with a drill or production string in the borehole. In those instances the tool has to pass through a smaller dimension and then has to be deployed in significantly larger tubulars. In the past cutting tools that have pivotally mounted arms that are hydraulically extended have been used for descaling or scraping the interior wall of a surrounding larger tubular after being run in through a smaller tubular. These devices were modified tubular cutters where the same pivoting blades were used but different end treatments were applied to accomplish the objective of cleaning or descaling rather than cutting through the tubular. It was determined that such modified blades fitted on line cutting tool bodies were marginally effective for cleaning or descaling. The reason was that there was very limited contact are at the cantilevered ends of the blades to accomplish that function. The present invention seeks to improve the cleaning ability of such a tool and addresses the issue with an articulated lower end for the blades so that when the blades are extended to a preferred angle of about 45 degrees, although other angles are contemplated, the lower ends are articulated into a near parallel orientation to the tubular wall so that the contact area is enhanced as the tool cleans while being rotated. The envisioned tool has other applications such as for honing the inside wall of a tubular, milling or cleaning around objects in the tubular in a direction moving toward the tubular axis or using the tool as a latch tool to anchor itself or attached tools or to move other tools within the tubular. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A tubular cleaning tool can be delivered through tubing and then hydraulically or mechanically actuated to rotate blades about respective pivot location into approximately a 45 degree orientation for commencement of tool rotation and cleaning a larger tubular that is below. Each of the blades has a cantilevered distal end that further features at least one articulated link. The outer periphery of the articulated distal segment has hard facing to enhance the cleaning effect and to reduce blade wear. The remainder of the blade outer surface can also have hard facing for similar reasons. The distal segment can be biased toward the surrounding tubular when the blades extend to put the segment in the needed orientation for cleaning. Alternative uses are envisioned such as honing or milling in the direction toward a tubular axis or latching or shifting tools already within the tubular.

DETAILED DESCRIPTION OF THE PREFERRED EMBODIMENT

Figure 1:
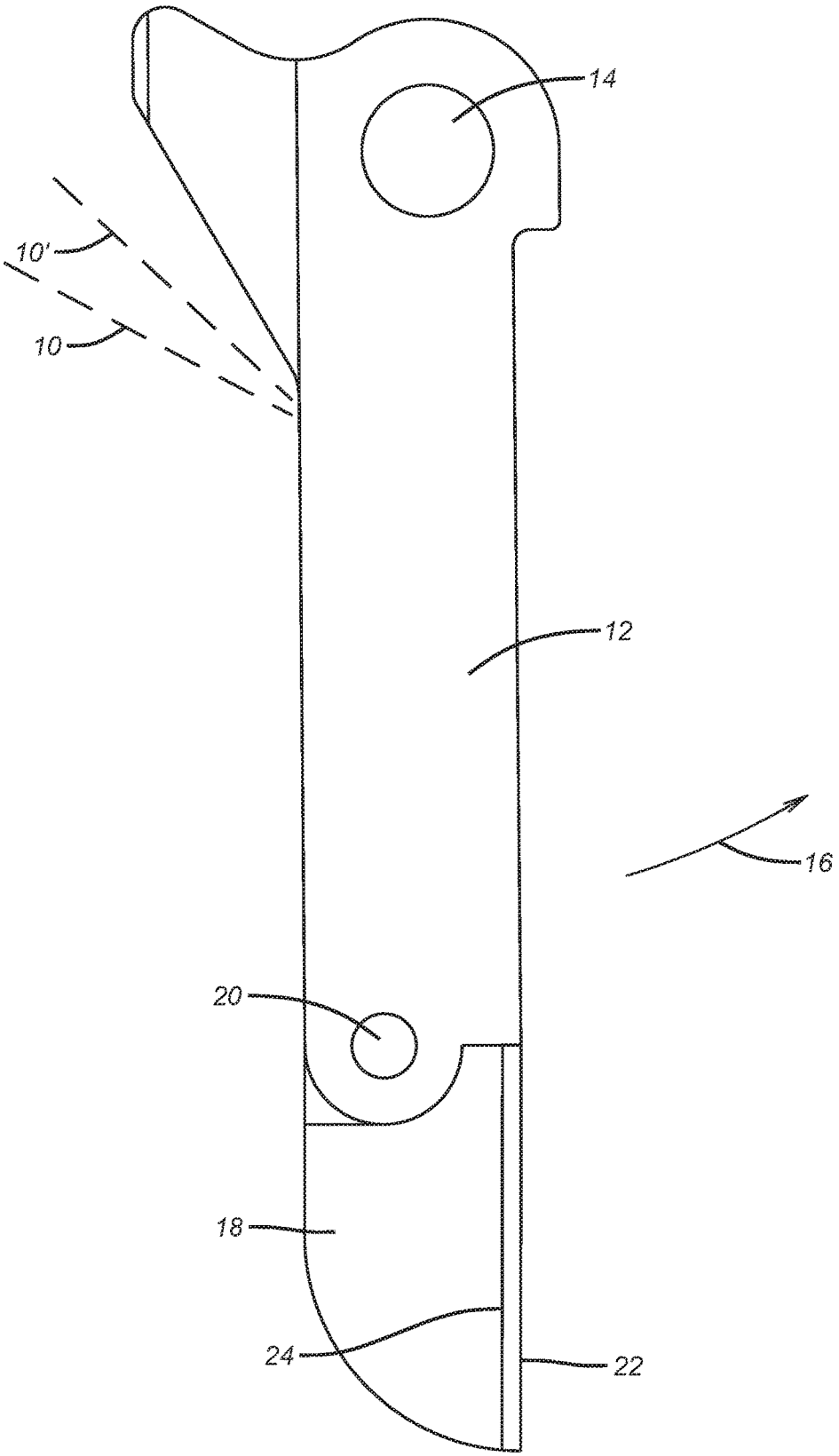
FIG. 1 is a side view of a typical blade of a blade assembly that can have one or more blades and the same or different link dimensions in at least one or a plurality of axially spaced pivot location in the retracted position with schematically illustrated radial extension travel stops.

Dashed lines 10 and 10' are intended to schematically illustrate a housing that has an optional travel stop when the at least one blade or knife upper arm 12 is powered or released to rotate about pivot 14 outwardly in the direction of arrow 16 to different radial extensions. Upper arm 12 is attached to a lower arm 18 that is pivotally mounted at pivot 20 to allow the lower arm 18 to rotate relative to upper arm 12. Hard facing 22 is on an exterior surface 24 of the lower arm 18. Exterior surface 24 can be curved to conform to the inside wall shape of tubular 26. In the extended position the lower arm 18 is in substantial alignment with the inside wall of a surrounding tubular 26 that is schematically illustrated in FIG. 2.

Figure 2:
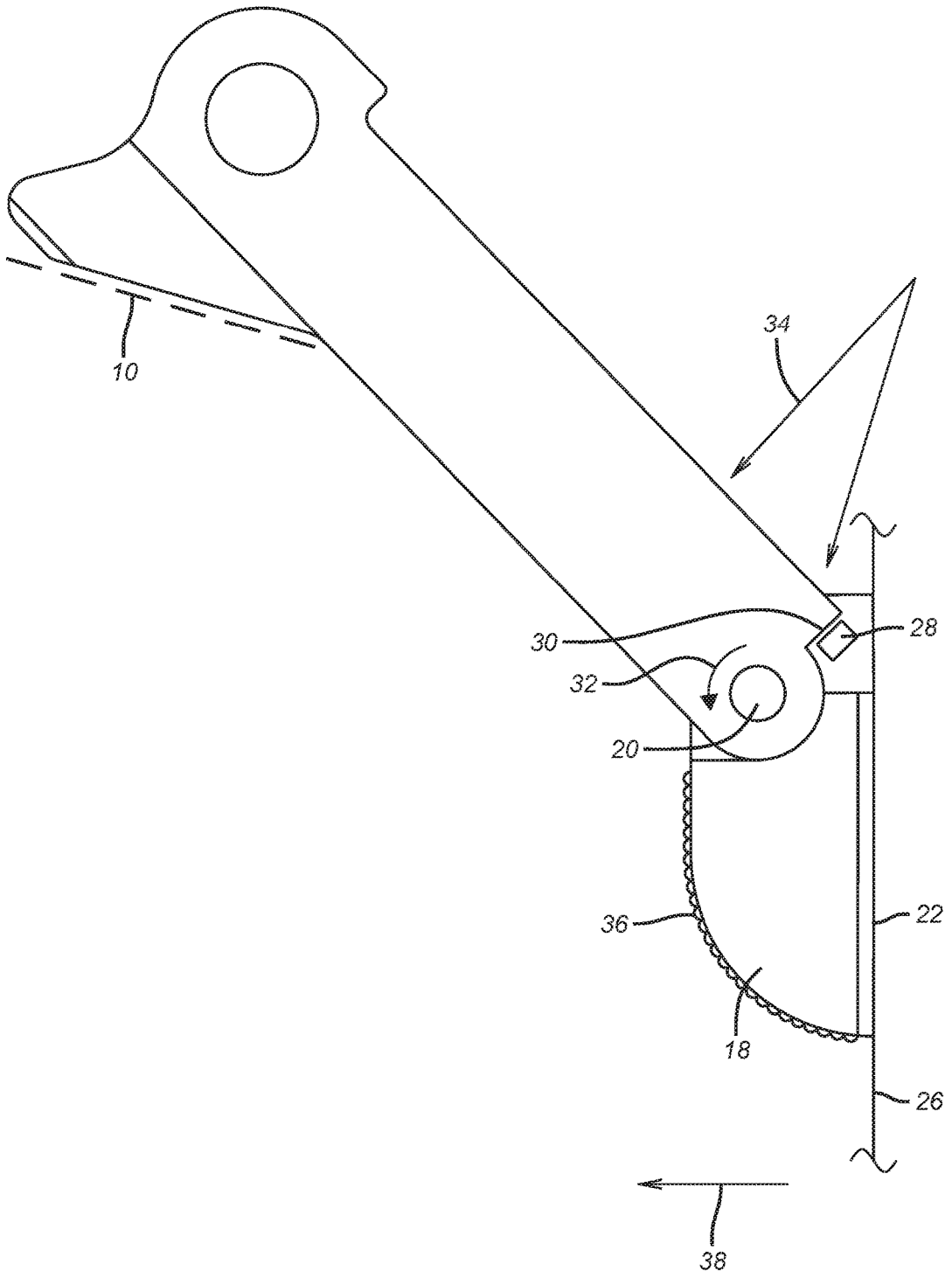
FIG. 2 is the view of FIG. 1 with the blade rotated to the operating position.

FIG. 2 shows the rotated view of upper arm 12 against travel stop 10 where the orientation of the arm 12 is at the preferred angle of 45 degrees. However, rotation of up to 90 degrees is envisioned while still letting the lower arm 18 align with the tubular 26. This angle can vary depending on the size difference between the tubing through which the tool is advanced and the tubing to be cleaned as well as the length of the upper arm 12. The lower arm 18 can also have an optional travel stop 28 so that for a predetermined size of tubular 26 to be cleaned, the rotation of upper arm 12 against the stop 10 also positions surface 30 at stop 28 on the lower arm 18 such that the orientation of the lower arm is substantially parallel to the axis of the tubular 26 that is being cleaned. Arrow 32 illustrates a rotational bias that can be a spring or hydraulic power to rotate the lower arm 18 until the stop 28 engages surface 30 so that the near parallel orientation of the hard facing 22 with the tubular 26 is achieved as shown in FIG. 2. Whichever way the rotational bias on lower arm 18 is accomplished, such bias can be overcome if there is resistance inside the tubular 26 so that the housing with the travel stop can continue to rotate without stalling as the lower arm 18 is deflected inwardly. The same feature is built into the upper arm 12 allowing it to be deflected radially inwardly and away from the tubular 26 should there be some internal obstruction on the inside wall of tubular 26.

Arrows 34 indicate that the outer face of the upper arm 12 can also have a surface treatment to reduce wear such as hard facing or carbide. While the lower arm 18 is shown with a single link, it can also have multiple links that can selectively move relatively or in tandem.

While a single blade assembly of upper and lower blades 12 and 18 are illustrated the housing 10 preferably has a plurality of such assemblies that can be all the same or different. The amount of radial extension from the housing 10 can be the same for all assemblies or different. Additionally there can be axially spaced rings of assemblies that have the same or different abilities to extend radially.

Figure 3:
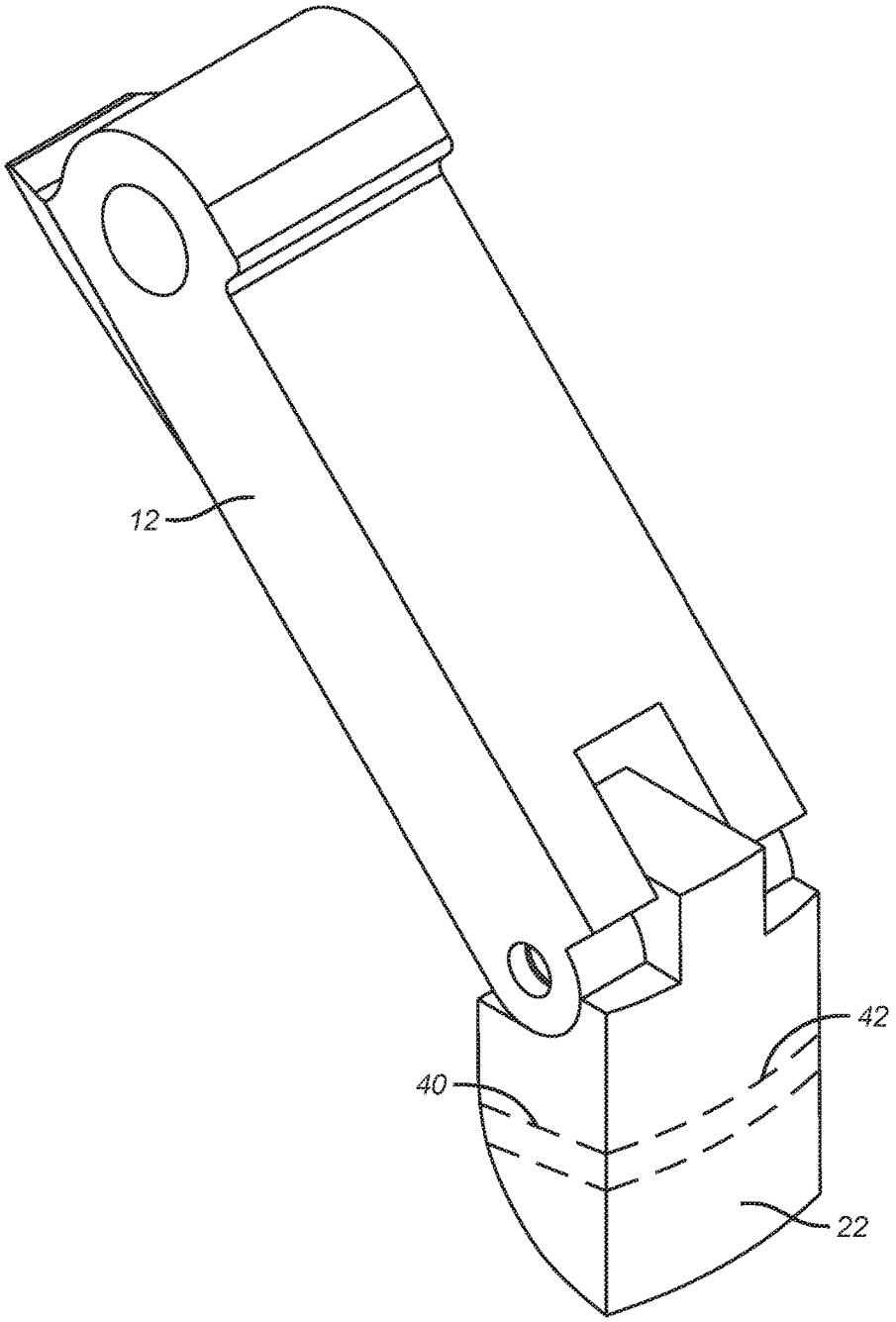
FIG. 3 is the view of FIG. 2 shown in perspective.

Alternative applications are envisioned. For example, 22 can be hard facing or/and carbide so that on contact with the wall of tubular 26 the inside surface can be not only cleaned of debris but can be honed to a predetermined dimension that is set by the travel stops on the housing 10 and/or 28 on the lower blade 18. Alternatively or additionally a milling profile 36 can be placed on the inside or/and lower portions of the lower blade 18 as shown in FIG. 2 so that the alignment with the tubular 26 can guide the tool while rotation and setting down weight can clean or mill depending on the nature of the surface treatment in the direction of arrow 38 as the housing 10 is advanced while also cleaning the wall of the tubular 26. FIG. 3 shows the use of one or more slots or projections 40 on one or more sides or 42 on the front that faces the tubular 26 for use to engage a mating profile that is not shown for the purposes of either locating the tool itself or shifting or otherwise operating other downhole tools. In the case of 42, rotation of the upper arm 12 can result in registry with the desired profile while in the case of 40 some housing rotation can result in the desired registry.

The tool can clean a surrounding string from within an inner string after an inner string has been severed to facilitate a plug and abandon procedure.

The above description is illustrative of the preferred embodiment and many modifications may be made by those skilled in the art without departing from the invention whose scope is to be determined from the literal and equivalent scope of the claims below:

We claim:

1. A multi-purpose tool for a subterranean location defined by an internal tubular wall, comprising:

a housing having at least one articulated blade assembly selectively moveable toward the tubular wall and back toward said housing;

said blade assembly comprising relatively rotatable upper and lower arms so that upon initial pivotal movement of said upper arm away from said housing about a single stationary pivot connection said lower arm moves out of an aligned position against said housing with said upper arm to a second position and an outer face of said lower arm is pivoted to alignment with the internal tubular wall for cleaning the internal tubular wall.

2. The tool of claim 1, wherein:

said upper arm is rotatably mounted to said housing.

3. The tool of claim 1, wherein:

said housing provides a travel stop to said upper arm after a predetermined movement.

4. The tool of claim 1, wherein:

said outer face has a shape conforming to the shape of the internal tubular wall.

5. The tool of claim 1, wherein:

said outer face has a surface treatment of hard facing or carbide.

6. The tool of claim 5, wherein:

said outer face has carbide that hones the internal tubular wall to a predetermined dimension.

7. The tool of claim 1, wherein:

said upper arm has an outer face that has surface treatment of hard facing or carbide.

8. The tool of claim 1, wherein:

said lower arm is forced to turn toward said internal tubular wall when said upper arm is moved away from said housing.

9. The tool of claim 8, wherein:

said force is delivered hydraulically or with a spring.

10. The tool of claim 8, wherein:

said force is overcome when said lower arm engages an obstruction on the internal tubular wall.

11. The tool of claim 1, wherein:

said upper arm is moved hydraulically or mechanically away from said housing until a travel stop on said housing is engaged by said upper arm.

12. The tool of claim 11, wherein:

said upper arm moves away from said travel stop if said lower arm or upper arm engages an obstruction on the internal tubular wall.

13. The tool of claim 1, wherein:

said upper arm rotates up to 90 degrees away from said housing.

14. The tool of claim 1, wherein:

said at least one articulated blade assembly comprises a plurality of articulated blade assemblies in one or a plurality of axially spaced pivot locations with identical radial extension capabilities.

15. The tool of claim 14, wherein:

said blade assemblies are identical.

16. The tool of claim 15, wherein:

said blade assemblies have the same range of motion;

said housing provides a travel stop to said upper arms after at least one predetermined movement.

17. The tool of claim 1, wherein:

said lower arm further comprises a latch feature to selectively engage to or within the inner tubular wall to other tools or anchoring thereto or movement thereof.

18. The tool of claim 1, wherein:

said lower arm further comprises hard facing or carbide on an interior or lower end such that movement of the lower arm while guided by the inner tubular wall cleans or mills in a direction heading away from the inner tubular wall as said lower arm is axially advanced.

19. The tool of claim 1, wherein:

said lower arm comprises a single link.

20. A multi-purpose tool for a subterranean location defined by an internal tubular wall, comprising:

a housing having at least one articulated blade assembly selectively moveable toward the tubular wall and back toward said housing;

said blade assembly comprising relatively rotatable upper and lower arms so that on movement of said upper arm away from said housing, an outer face of said lower arm is positioned in alignment with the internal tubular wall for cleaning the internal tubular wall;

said lower arm has a travel stop that selectively engages said upper arm when said outer face is in substantial alignment with the internal tubular wall.

21. A multi-purpose tool for a subterranean location defined by an internal tubular wall, comprising:

a housing having at least one articulated blade assembly selectively moveable toward the tubular wall and back toward said housing;

said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

said upper arm is rotatably mounted to said housing;

said lower arm has a travel stop that selectively engages said upper arm when said outer face is in substantial alignment with the internal tubular wall.

22. The tool of claim 21, wherein:

said outer face has a shape conforming to the shape of the internal tubular wall.

23. The tool of claim 22, wherein:

said outer face has a surface treatment of hard facing or carbide.

24. The tool of claim 23, wherein:

said lower arm is forced to turn toward said internal tubular wall when said upper arm is moved away from said housing.

25. A method of performing a subterranean operation, comprising:

providing a tool having a housing having at least one articulated blade assembly selectively moveable toward the tubular wall and back toward said housing, said blade assembly comprising relatively rotatable upper and lower arms so that upon initial pivotal movement of said upper arm away from said housing about a single stationary pivot connection said lower arm moves out of an aligned position against said housing with said upper arm to a second position and an outer face of said lower arm is pivoted to alignment with the internal tubular wall for cleaning the internal tubular wall;

running in said tool to a subterranean location defined by an internal tubular wall;

operating said tool at the subterranean location.

26. The method of claim 25, comprising:

mounting said upper arm rotatably to said housing.

27. The method of claim 26, comprising:

providing a travel stop on said lower arm that selectively engages said upper arm when said outer face is in substantial alignment with the internal tubular wall.

28. The method of claim 27, comprising:

conforming the shape of said outer face of the internal tubular wall.

29. The method of claim 28, comprising:

providing a surface treatment of hard facing or carbide on said outer face.

30. The method of claim 29, comprising:

forcing said lower arm to turn toward said internal tubular wall when said upper arm is moved away from said housing.

31. The method of claim 25, comprising:

providing a travel stop on said housing to said upper arm after a predetermined movement.

32. The method of claim 25, comprising:

providing a travel stop on said lower arm that selectively engages said upper arm when said outer face is in substantial alignment with the internal tubular wall.

33. The method of claim 25, comprising:

conforming the shape of said outer face to the shape of the internal tubular wall.

34. The method of claim 25, comprising:

providing a surface treatment of hard facing or carbide on said outer face.

35. The method of claim 34, comprising:

providing carbide on said outer face that hones the internal tubular wall to a predetermined dimension.

36. The method of claim 25, comprising:

providing a surface treatment of hard facing or carbide on an outer face of said upper arm.

37. The method of claim 25, comprising:

forcing said lower arm to turn toward said internal tubular wall when said upper arm is moved away from said housing.

38. The method of claim 25, comprising:

moving said upper arm hydraulically or mechanically away from said housing until a travel stop on said housing is engaged by said upper arm.

39. The method of claim 38, comprising:

moving said upper arm away from said travel stop if said lower arm or upper arm engages an obstruction on the internal tubular wall.

40. The method of claim 25, comprising:

rotating said upper arm up to 90 degrees away from said housing.

41. The method of claim 25, comprising:

providing as said at least one articulated blade assembly a plurality of articulated blade assemblies in one or a plurality of axially spaced pivot locations with identical radial extension capabilities.

42. The method of claim 41, comprising:

making said blade assemblies identical.

43. The method of claim 42, comprising:

making said blade assemblies have the same range of motion;

providing a travel stop on said housing for said upper arms after at least one predetermined movement.

44. The method of claim 41, comprising:

making said blade assemblies different.

45. The method of claim 25, comprising:

providing hard facing or carbide on said lower arm on an interior or lower end such that movement of the lower arm while guided by the inner tubular wall cleans or mills in a direction heading away from the inner tubular wall as said lower arm is axially advanced.

46. The method of claim 25, comprising:

forming said lower arm from a single link.

47. The method of claim 25, comprising:

providing as said at least one articulated blade assembly a plurality of articulated blade assemblies in one or a plurality of axially spaced rings with different radial extension capabilities.

48. A method of performing a subterranean operation, comprising:

providing a tool having a housing having at least one articulated blade assembly selectively moveable toward the tubular wall and back toward said housing, said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

running in said tool to a subterranean location defined by an internal tubular wall;

operating said tool at the subterranean location;

forcing said lower arm to turn toward said internal tubular wall when said upper arm is moved away from said housing;

delivering said forcing hydraulically or with a spring.

49. A method of performing a subterranean operation, comprising:

providing a tool having a housing having at least one articulated blade assembly selectively moveable toward the tubular wall and back toward said housing, said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

running in said tool to a subterranean location defined by an internal tubular wall;

operating said tool at the subterranean location;

forcing said lower arm to turn toward said internal tubular wall when said upper arm is moved away from said housing;

overcoming said forcing when said lower arm engages an obstruction on the internal tubular wall.

50. A method of performing a subterranean operation, comprising:

providing a tool having a housing having at least one articulated blade assembly selectively moveable toward the tubular wall and back toward said housing, said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

running in said tool to a subterranean location defined by an internal tubular wall;

operating said tool at the subterranean location;

providing a latch feature on said lower arm to selectively engage to or within the inner tubular wall to other tools or anchoring thereto or movement thereof.

51. A multi-purpose tool for a subterranean location defined by an internal tubular wall, comprising:

a housing having at least one articulated blade assembly selectively moveable toward the tubular wall and back toward said housing;

said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

said at least one articulated blade assembly comprises a plurality of articulated blade assemblies in one or a plurality of axially spaced pivot locations with different radial extension capabilities.

52. The tool of claim 51, wherein:

said blade assemblies are different.

53. The tool of claim 52, wherein:

said blade assemblies have different ranges of motion;

said housing provides a travel stop to said upper arms after at least one predetermined movement.

54. A method of performing a subterranean operation, comprising:

providing a tool having a housing having at least one articulated blade assembly selectively moveable toward the tubular wall and back toward said housing, said blade assembly comprising relatively rotatable upper and lower arms so that upon initial pivotal movement of said upper arm away from said housing about a stationary pivot said lower arm moves out of an aligned position against said housing with said upper arm to a second position and an outer face of said lower arm is pivoted to alignment with the internal tubular wall for cleaning the internal tubular wall;

running in said tool to a subterranean location defined by an internal tubular wall;

operating said tool at the subterranean location;

providing as said at least one articulated blade assembly a plurality of articulated blade assemblies in one or a plurality of axially spaced pivot locations with identical radial extension capabilities;

making said blade assemblies identical;

making said blade assemblies have the different range of motion;

providing a travel stop on said housing for said upper arms after at least one predetermined movement.

* * * * *